US006733421B1

(12) United States Patent
Jones

(10) Patent No.: US 6,733,421 B1
(45) Date of Patent: May 11, 2004

(54) HAND REHABILITATION DEVICE AND METHOD FOR THE USE THEREOF

(76) Inventor: Durmon Jones, 3880 N. Colorado Ave., Indianapolis, IN (US) 46226

( * ) Notice: Subject to any disclaimer, the term of this patent is extended or adjusted under 35 U.S.C. 154(b) by 0 days.

(21) Appl. No.: 09/405,672

(22) Filed: Sep. 24, 1999

(51) Int. Cl.[7] ..... A63B 23/14; A63B 23/16

(52) U.S. Cl. ..... 482/44; 482/45; 482/49

(58) Field of Search ..... 482/44–48, 49, 482/148; D21/682, 684, 478–480, 484–486, 489, 491, 500–502; 446/491, 111, 85, 128, 124; 472/51, 57; 273/156

(56) References Cited

U.S. PATENT DOCUMENTS 121,289 A * 11/1871 Kops
1,428,206 A * 9/1922 Benton
1,701,190 A * 2/1929 Paulson
1,895,611 A * 10/1933 Doak
2,493,435 A * 1/1950 Archambault
3,094,792 A * 6/1963 Morgan
3,129,939 A * 4/1964 Stock ..... 482/47
3,235,263 A * 2/1966 Smith ..... 273/156
3,672,681 A * 6/1972 Wolf ..... 273/157 R
4,032,155 A * 6/1977 Thomas ..... 273/156
4,182,072 A * 1/1980 Much ..... 46/17
D276,926 S * 12/1984 Peterson
4,547,160 A * 10/1985 Labelle ..... 434/195
4,602,908 A * 7/1986 Kroeber ..... 446/128
5,076,569 A * 12/1991 Gotter ..... 272/68
D472,260 S * 6/2000 Burr ..... D21/684

* cited by examiner

*Primary Examiner*—Nicholas D. Lucchesi
*Assistant Examiner*—L. Amerson
(74) *Attorney, Agent, or Firm*—Sawyer Law Group LLP

(57) ABSTRACT

The present invention provides a method for rehabilitating a user's hand. The method comprises providing a block, the block having a plurality of sides, wherein at least one of the plurality of sides has at least one indentation thereon and using the hand to rotate the block. Through the use of a method and apparatus in accordance with the present invention, a user will be able to perform therapeutic hand exercises without the complications of existing therapeutic devices. The present invention provides a durable, cost effective, and easy to use device that will increase hand flexibility, strength and endurance. Furthermore, the device offers significant therapy to the distal fingers.

2 Claims, 5 Drawing Sheets

HAND REHABILITATION DEVICE AND METHOD FOR THE USE THEREOF

FIELD OF INVENTION

The present invention relates generally to a hand rehabilitation device and a method of use thereof.

BACKGROUND OF THE INVENTION

Hand injuries and other hand problems are very common for people of all ages. Most problems are treated with different forms of therapeutic exercise. Therapeutic exercise is a form of care that attempts to correct and alleviate problems associated with most hand injuries through various forms of hand movements. These exercises are designed to increase the flexibility, strength and endurance of the injured hand.

Many conventional therapeutic exercises involve the use of hand-held devices designed to be squeezed and manipulated by the user. FIG. 1 represents a typical therapeutic hand exercise device 10. Many of these devices utilize a single or double layer resilient outer covering 12 filled with granular particles 14. These particles are usually sand, seed, grain, or other granular or crystallized particles which have flat surfaces and/or sharp points. However, the sharp surfaces or points of the granular or crystallized filler material will abrade the interior surface of the resilient bladder and cause premature wear resulting in short product life, and leakage of the filler material.

What is needed is a simple therapeutic hand exercise device that is low in cost and easy to use. The present invention addresses such a need.

SUMMARY OF THE INVENTION

The present invention provides a method for rehabilitating a user's hand. The method comprises providing a block, the block having a plurality of sides, wherein at least one of the plurality of sides has at least one indentation thereon and using the hand to rotate the block.

Through the use of a method and apparatus in accordance with the present invention, a user will be able to perform therapeutic hand exercises without the complications of existing therapeutic devices. The present invention provides a durable, cost effective, and easy to use device that will increase hand flexibility, strength and endurance. Furthermore, the device offers significant therapeutic treatment to the distal fingers.

DETAILED DESCRIPTION OF THE INVENTION

The present invention provides a method and apparatus to be utilized for hand therapy. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiments shown but is to be accorded the widest scope consistent with the principles and features described herein.

Figure 1:
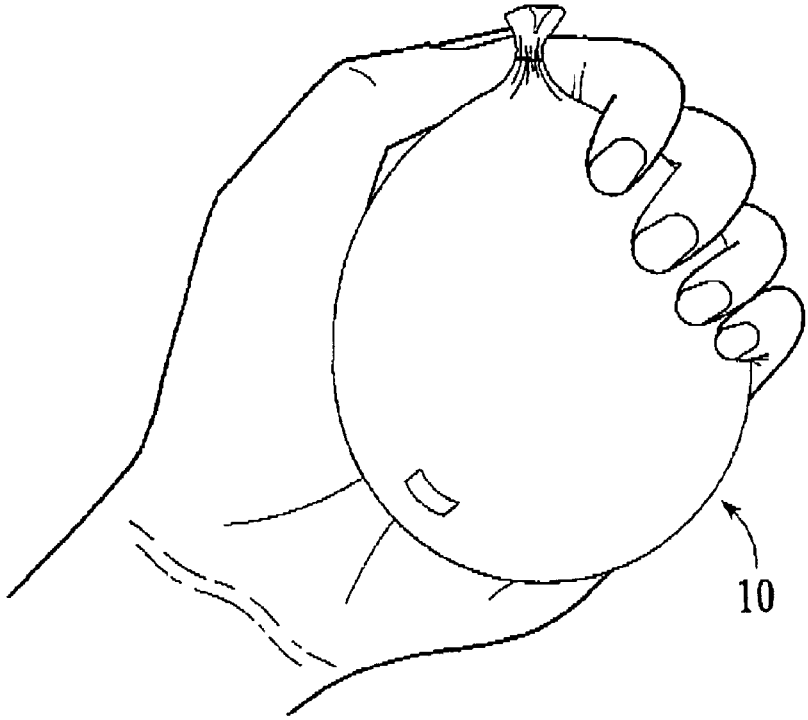
FIG. 1 (PRIOR ART)
FIG. 1 is a conventional therapeutic hand exercise device.
Figure 1A:
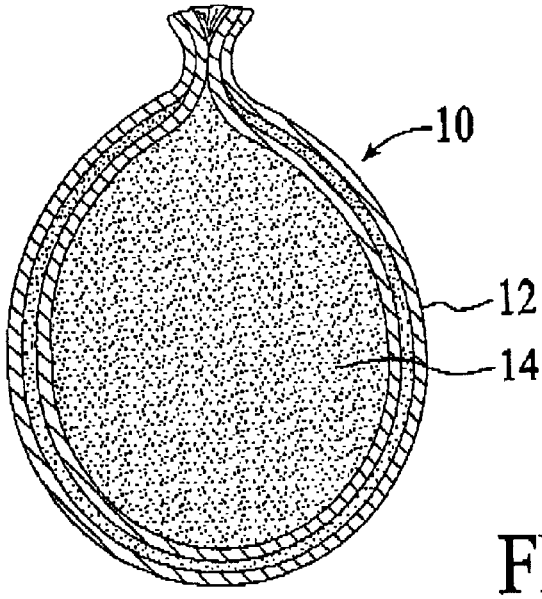
FIG. 1A (PRIOR ART)
FIG. 1A is a side view of a conventional therapeutic hand exercise device.
Figure 2:
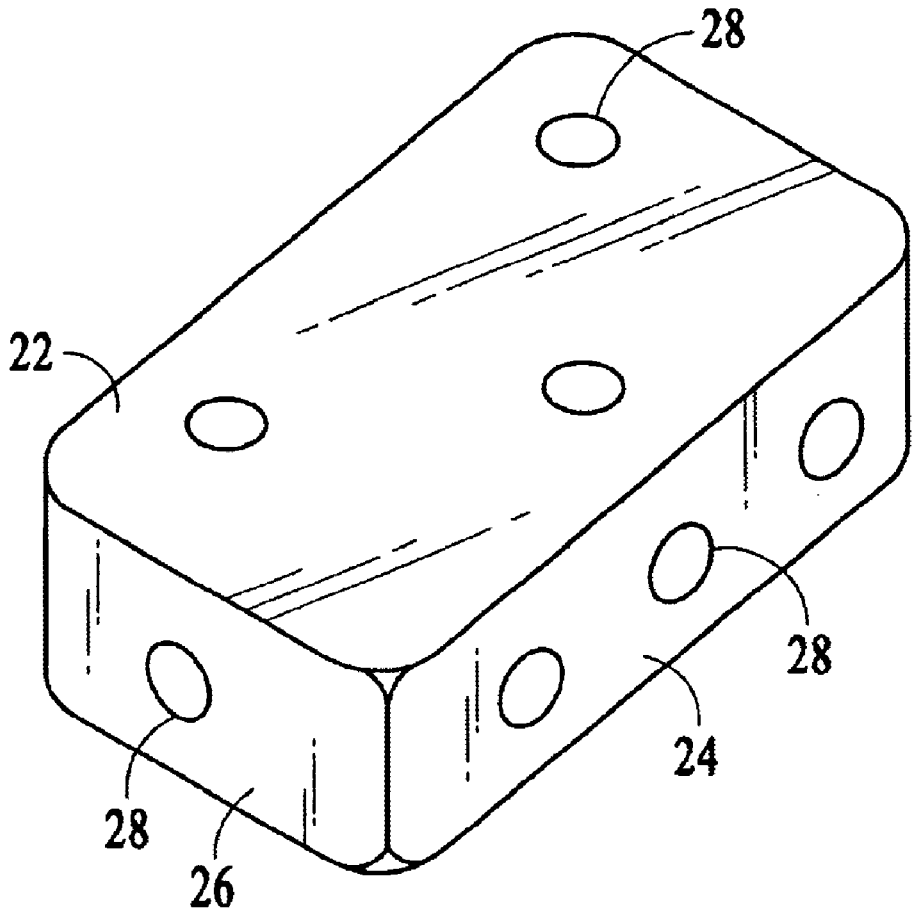
FIG. 2 is a perspective view of a therapeutic block in accordance with the present invention.
Figure 2A:
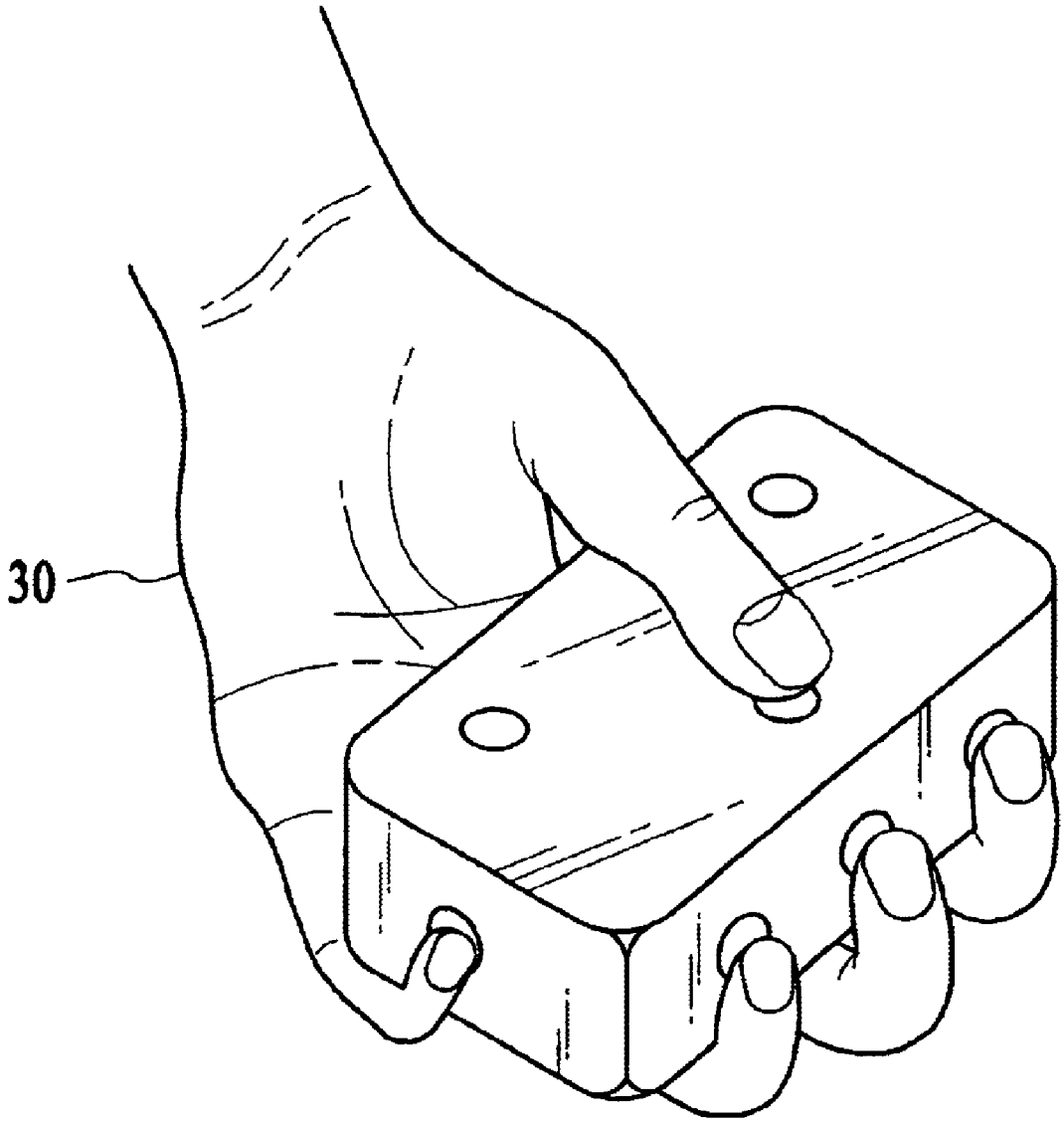
FIG. 2A illustrates the placement of a user's hand during the use of a device in accordance with the present invention.

The method and apparatus in accordance with the present invention is disclosed in the context of a preferred embodiment. The preferred embodiment allows for the use of a therapeutic block. FIG. 2 depicts a perspective view of a therapeutic block 20 in accordance with the present invention. The therapeutic block 20 is preferably made of wood or plastic and has a plurality of sides. Preferably, there are two long wide sides 22, two long narrow sides 24 and two end sides 26 upon which there are circular indentations 28. The block 20 preferably has three indentations 28 on each long wide side 22, three indentations 28 on each long narrow side 24, and one indentation 28 on each end side 26. These indentations 28 serve as points of concentration in which a user places his finger and thumb tips. For example, while holding the block 20 in the palm of the hand, the user attempts to place his finger tips into the indentations 28. Once the user places his finger tips into all the indentations 28 within possible reach, the user removes his finger tips and attempts to rotate the block 20 with his hand by placing his finger tips into the indentations 28 on another side of the therapeutic block 20. Preferably, the user rotates the block 20 as many times as possible. FIG. 2A illustrates the placement of a user's hand 30 during the use of a device in accordance with the present invention.

Although the preferred embodiment is disclosed in the above-described manner with regard to the indentations, one of ordinary skill in the art will readily recognize that variety of indentation configurations could be utilized while remaining within the spirit and scope of the invention.

Figure 3:
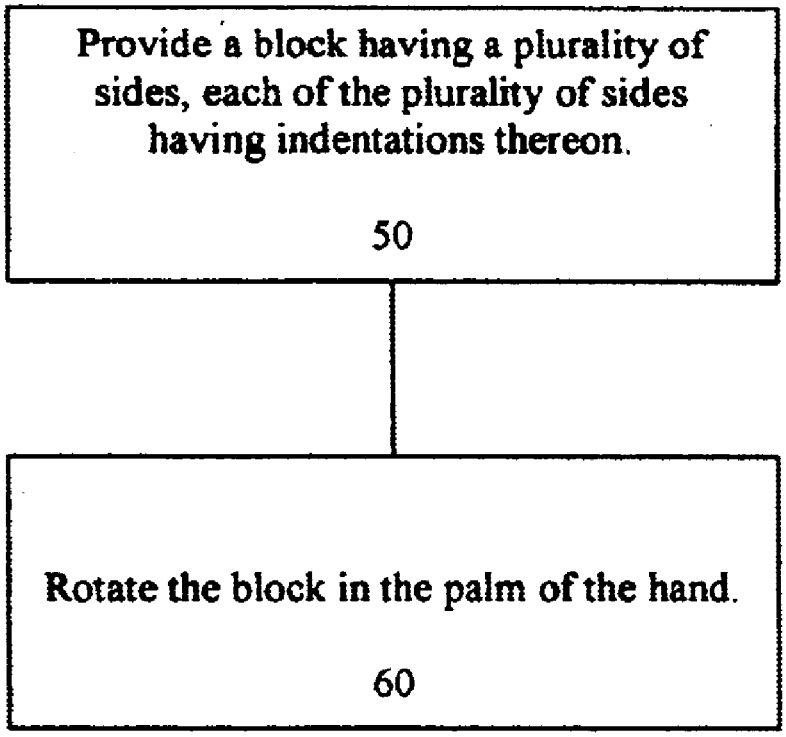
FIG. 3 is a high-level flowchart of the method in accordance with the present invention.

To more particular describe the method in accordance with present invention, FIG. 3 is a high-level flowchart of the method in accordance with the present invention. First, a block having a plurality of sides, each of the plurality of sides having indentations thereon, is provided, via step 50. Next, a user rotates the block in the palm of his hand, via step 60. Although the preferred embodiment is rectangular in shape, one of ordinary skill in the art will readily recognize that a variety of shapes e.g. circular, spherical, or triangular could be utilized while remaining within the spirit and scope of the invention.

Figure 4:
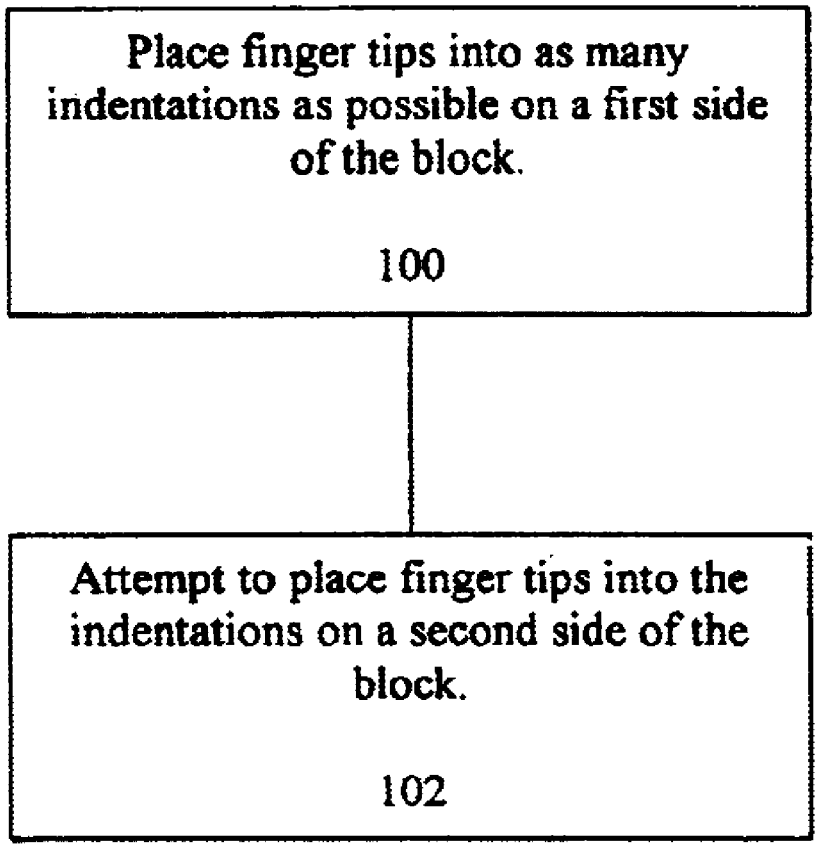
FIG. 4 is a flowchart of a portion of FIG. 3

To more specifically describe the method of the present invention, refer now FIG. 4 which is a detailed flowchart of step 60 of FIG. 3. First, the user places his finger tips into as many indentations as possible on a first side of the block, via step 100. Next, the user attempts to place his finger tips into the indentations on a second side of the block, via step 102. Preferably, these steps are repeated as many times as possible.

Through the use of a method and apparatus in accordance with the present invention, a user will be able to perform therapeutic hand exercises without the complications of existing therapeutic devices. The present invention provides a durable, cost effective, and easy to use device that will increase hand flexibility, strength and endurance. Furthermore, the device offers significant therapy to the distal fingers.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A hand-held rehabilitation device, comprising:

a singular rectangular block having a plurality of sides, the plurality of sides comprising two long narrow sides, two long wide sides and two end sides; wherein each of the two long narrow sides includes only three circular indentations thereon; each of two long wide sides includes only three circular indentations thereon; and each of the two end sides includes only one circular indentation thereon; and wherein at least one of the three circular indentations on each of the two long wide sides is offset relative to the other circular indentations.

2. A hand-held rehabilitation device, comprising:

a singular rectangular block having a plurality of sides, the plurality of sides comprising two long narrow sides, two long wide sides and two end sides; wherein each of the two long narrow sides includes only three circular indentations thereon; each of two long wide sides includes only three circular indentations thereon; and each of the two end sides includes only one circular indentation thereon; and wherein the three circular indentations on each of the two long wide sides form a triangular pattern.

* * * * *